United States Patent [19]

Kehrli et al.

[11] Patent Number: 4,831,779

[45] Date of Patent: May 23, 1989

[54] SELF-DRAINING PANEL THRESHOLD COMBINATION

[75] Inventors: David W. Kehrli, Fairport; Allen J. Burrous, Webster, both of N.Y.

[73] Assignee: Schlegel Corporation, Rochester, N.Y.

[21] Appl. No.: 238,740

[22] Filed: Aug. 31, 1988

[51] Int. Cl.[4] ..... E06B 1/70

[52] U.S. Cl. ..... 49/471; 49/380; 49/469

[58] Field of Search ..... 49/471, 469, 467, 476, 49/380

[56] References Cited

U.S. PATENT DOCUMENTS

| | | | |
|---|---|---|---|
| 322,086 | 7/1885 | Batholomew | 49/471 X |
| 2,202,482 | 5/1940 | Dahl | 49/476 |
| 3,410,027 | 11/1968 | Bates | 49/471 |
| 3,851,420 | 12/1974 | Tibbetts | 49/471 |
| 4,055,917 | 11/1977 | Coller | 49/469 |
| 4,310,991 | 1/1982 | Seely | 49/471 X |
| 4,513,536 | 4/1985 | Giguere | 49/471 X |
| 4,686,793 | 8/1987 | Mills | 49/471 |

*Primary Examiner*—Philip C. Kannan
*Attorney, Agent, or Firm*—Cumpston & Shaw

[57] ABSTRACT

An improved self-draining panel threshold combination for a panel such as a door or the like which is of simple design and construction, and passes industry air and water penetration requirements without the use of separate corner seals or door bottom seals. The door threshhold combination comprises weatherseals around the entire periphery of the door lying in a weatherseal plane. An open-ended water trough in the threshold extends from one jamb to the other and lies substantially in the weatherseal plane for catching any water that leaks into and past the weatherseals. The threshold has a weatherseal adjacent the water trough that is adapted when flexed by the closed door to allow entry of water into the open end of the water through, and when unflexed upon movement of the door to its open position to cover the open end to prevent foreign material from entering the trough. A drainage system is provided for draining water entering the water trough out of the threshold.

12 Claims, 2 Drawing Sheets

SELF-DRAINING PANEL THRESHOLD COMBINATION

FIELD OF THE INVENTION

The present invention relates generally to thresholds, and more particularly to an improved self-draining panel threshold combination.

BACKGROUND OF THE INVENTION

Self-draining door threshold combinations are generally well known in the art, as exemplified by U.S. Pat. Nos. 3,851,420, 4,055,917 and 4,686,793. One of the disadvantages of the self-draining door threshold combinations disclosed in these patents is that they all rely on a door bottom seal in combination with dust or corner plugs that provide a seal at the intersection of the threshold and jamb seals. A disadvantage of the door combination of bottom and corner seals is that they are not only costly to manufacture and to install, but additionally require means for adjusting the door bottom relative to the sill of the threshold, thereby greatly increasing the labor installation costs. Another disadvantage of the known door bottom seals is that they may increase the force required to close the door, particularly in those situations where, because of misalignment, the door bottom seals are over compressed or the threshold support surface is uneven or out of square. Still another disadvantage of the combination of door bottom and corner seals is that excessively wide seals are needed. Additionally, the seals are not completely effective to prevent water leakage past the seals in normal situations, and particularly in those situations where the door is subjected to high driving winds and differential pressure on opposite sides of the door which drive the water into and past the seals. High water leakage occurs where the door bottom seals are adjusted relative to the threshold, and particularly where the door and seal surfaces do not mate exactly.

Although the door thresholds in the aforementioned patents disclose drainage means for draining water to the exterior of the threshold, the drainage systems fail when the door and air seals are subjected to pouring rain driven by high winds and resultant pressure differential. In such situations, the drainage system and any troughs therein are filled with water, and the backed-up water is forced through the drainage system and the door bottom seals into the inner room.

U.S. Pat. Nos. 2,202,482, 3,079,653 and 4,513,536 are cited to show other types of door bottom and sill seals which are of complicated design, all of which suffer from the aforementioned recited disadvantages.

Therefore, an object of the present invention is to provide an improved self-draining panel threshold combination that consistently passes industry water penetration requirements, yet is of simple design and construction. The improved panel threshold combination eliminates the need for door bottom seals and corner seals, and the costly requirement of exactly adjusting the door bottom to the threshold sill.

SUMMARY OF THE INVENTION

The objects of this invention are accomplished by providing an improved self-draining panel threshold combination comprising:

a frame including a threshold for a panel movable between open and closed positions, the frame surrounding the peripheral edges of the panel in its closed position;

weatherseals on the frame and threshold lying in a common weatherseal plane for flexing and sealingly engaging the panel in its closed position;

a water trough in the threshold having a fully open end extending from one end of the threshold to the other end thereof and lying substantially in the weatherseal plane for catching water that is blown into and past the weatherseals and runs along the panel edges into the open end of the water trough;

the threshold weatherseal further having a portion thereof extending across the open end of the water trough to prevent foreign material from entering the trough when the panel is open and the weatherseal is unflexed; and drainage means in the threshold for draining water entering the water trough out of the threshold.

A further object of the present invention is to provide a self-draining threshold for a panel such as door comprising:

a base plate;

a first sill member comprising a part of the base plate and having a first wall extending upwardly from the base plate;

a second sill member comprising a part of the base plate adjacent the first sill member and having a second wall extending upwardly from the base plate and spaced from the first wall to form a water trough having an open end for receiving water;

an elongate weatherseal having a first leg and a second panel engaging leg wherein the first leg is mountable on the first wall and the second leg in its unflexed condition extends across the open end of the water trough into substantial engagement with the second wall to prevent foreign material from entering the trough; and drainage means in the threshold for draining water entering the water trough out of the threshold.

A still further object of the invention is to provide a self-draining panel threshold combination wherein an outer wall thereof has a pivotal flap mounted over the drainage opening to prevent air and water from blowing into and through the opening.

The many problems attempted to be overcome by the door seals of the prior art patents, such as construction tolerances, warping, sagging of the door, effective drain off of water blown against the door, and the changing of many parameters during use and wear of the door system, are all overcome by the improved self-draining panel threshold combination of this invention. Specific advantages of the panel threshold combination of this invention over those described in the prior art are (1) the total elimination of door bottom seals, (2) the total elimination of threshold/sill corner plug/seals, (3) elimination of fabrication requirements for the threshold support, (4) total elimination of adjustability requirements for threshold and door bottom seals, (5) total elimination of field adjustments as they relate to the threshold/sill seals, (6) reduction in manufacturing inventory and cost to produce a door seal system due to component reduction, (7) the achievement of low air leakage rates that are approximately 70% lower than industry standard, (8) elimination of closing force problems that occur as a result of the door bottom seals being overcompressed or the threshold support, such as a slab, being out-of-square, (9) providing a sealing system that is applicable to sill or threshold widths of varying width and length, and to all types of entry doors, sliding and swinging patio doors, residential and commercial markets, as well as doors manufactured from all types of materials, (10) elimination of the migration of foreign material such as dirt, leaves, stones, paper, insects or the like into the water trough in the threshold, and (11) covering the open end of the trough in the open position of the door, thereby reducing the unsightliness of an opening in the threshold.

BRIEF DESCRIPTION OF THE DRAWINGS

In the detailed description of the invention presented below, reference is made to the accompanying drawings, in which.

BRIEF DESCRIPTION OF THE INVENTION

Figure 1:
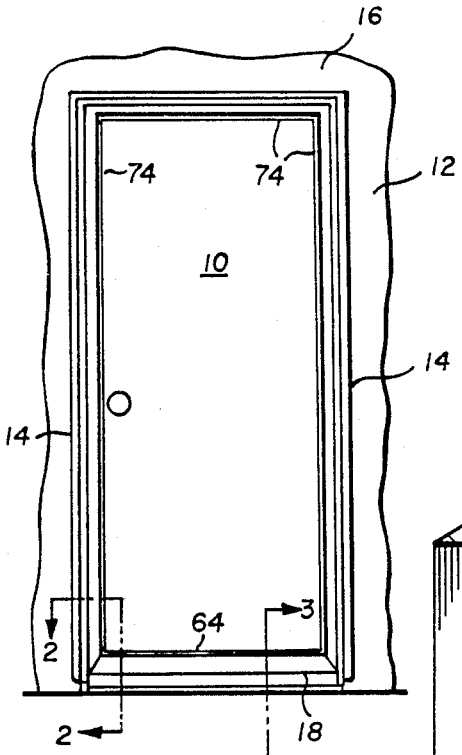
FIG. 1 is a segmental view in elevation of a door, door frame and threshold combination in which a preferred embodiment of the present invention is shown.
Figure 2:
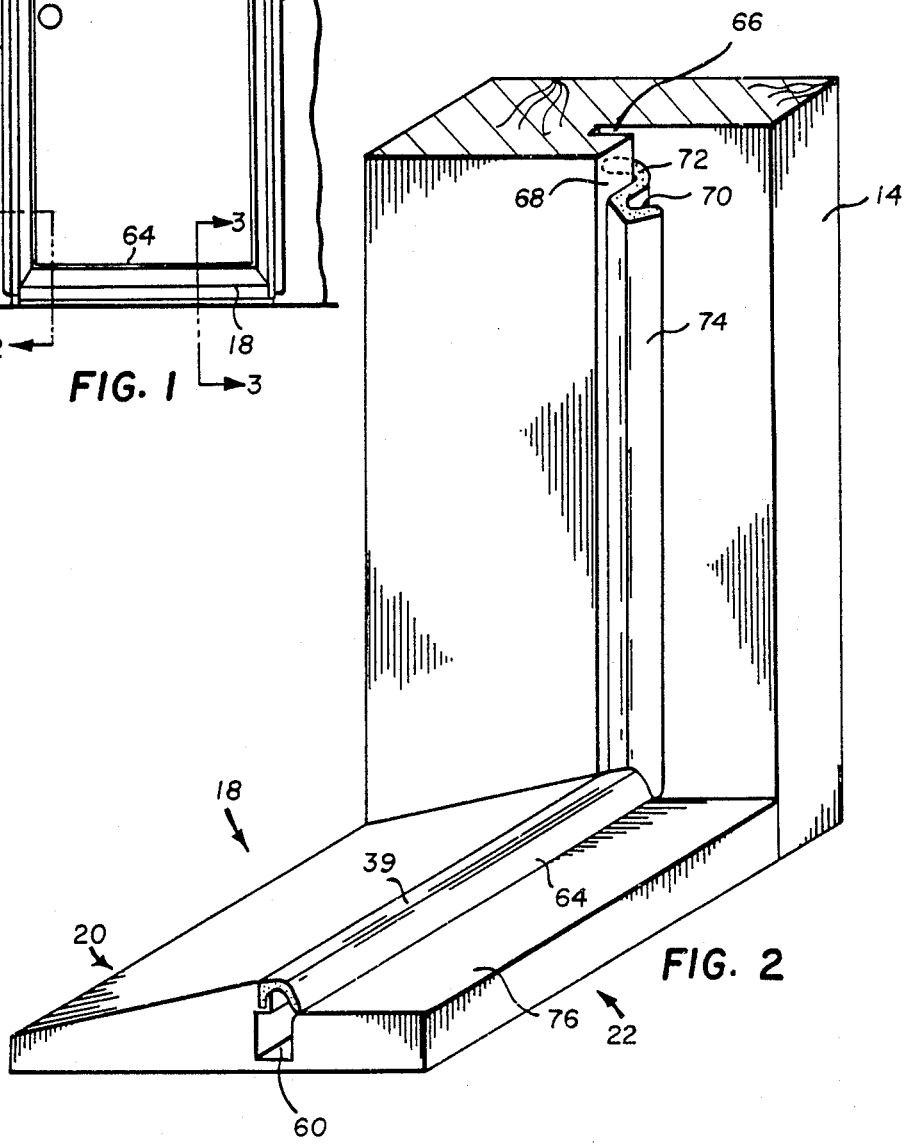
FIG. 2 is an enlarged section view in perspective taken substantially along line 2—2 of FIG. 1 with the cross-sectional details of the threshold omitted.

With reference to FIGS. 1 and 2, a preferred embodiment of a panel threshold 18 of the present invention is incorporated in combination with an in swinging panel, such as a door 10, formed of any convenient material. The door 10 further includes a door frame 12 within which door 10 is mounted, comprising a pair of upright jambs 14 connected together at the top by a header 16, and further having the threshold 18 at the bottom extending from one jamb to the opposite jamb. The door frame 12 can be made of any suitable material, such as wood, plastic or metal. The door 10 and frame 12 can preferably be pre-assembled and installed as a unit at the building site, or can be built up part-by-part at the building site.

Figure 3:
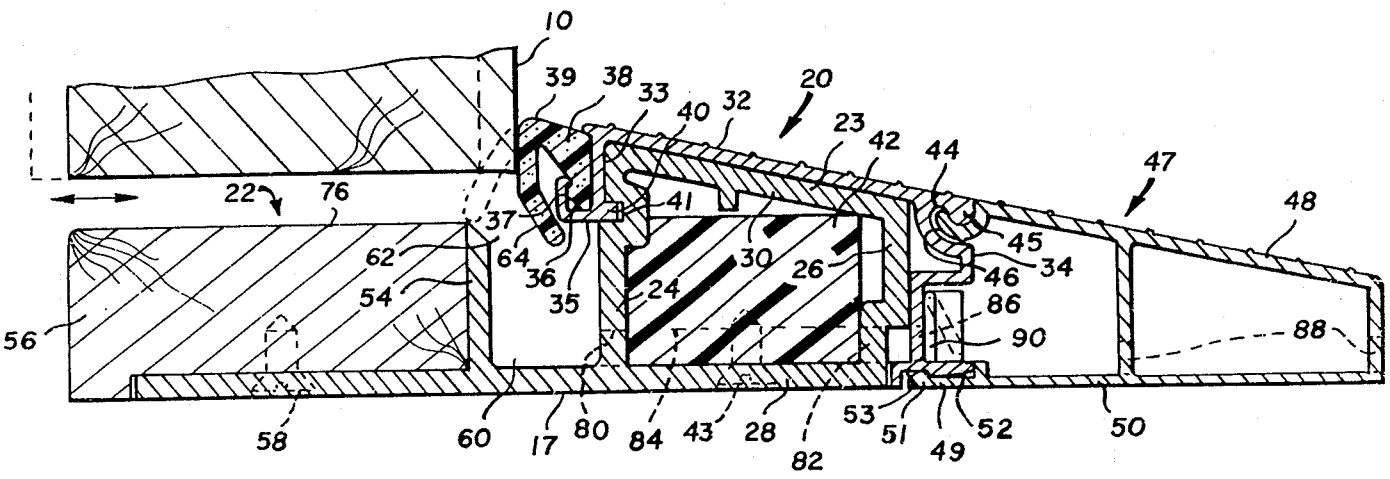
FIG. 3 is an enlarged section view taken substantially along line 3—3 of FIG. 1.

With reference to FIG. 3, the threshold 18 has an exterior sill member 20 and an interior sill member 22. The exterior and interior sill members 20, 22 respectively of threshold 18 are supported by a mutual base plate 17. The sill members may be manufactured from steel, aluminum, wood, plastic, or combinations thereof, and may be extruded or injection molded or fabricated by any suitable process that lends itself to these materials.

The exterior sill member 20 comprises a tubular member 23 having an inner upwardly extending wall 24, and an opposite outer upwardly extending wall 26. A part of base plate 17 forms a lower wall 28 of tubular member 23. An upper wall 30 of tubular member 23 supports a foot plate 32 having inner and outer depending wall portions 33, 34 respectively that snugly receive the upwardly extending walls 24, 26. Inner wall portion 33 has a hook 35 at one end thereof forming a blind slot 36 for receiving a bead 37 on one leg 38 of an elongate weatherseal 39 of substantially V-shaped cross section. Inner wall portion 33 further has a laterally extending elongate rib 40 that nests in an elongate slot 41 in wall 24 of tubular member 23 for securing foot plate 32 and depending wall portions 33, 34 to tubular member 23. A moisture resistant block 42, formed of plastic or wood, is mounted within tubular member 23 and is secured thereto by a screw 43 extending through base plate 17 into block 42.

Outer wall portion 34 of foot plate 32 has an elongate arcuate slot 44 at one end thereof defining an elongate semi-cylindrical pivot member 45. An elongate semi-cylindrical socket member 46 of a threshold extender 47 extends within arcuate slot 44 for rotatably receiving pivot member 45. The threshold extender 47 is preferably an extrusion of plastic or metal having an upper wall 48 that is an extension of foot plate 32. Extender 47 is secured to exterior sill member 20 by a flexible finger 49 extending outwardly from a lower wall 50 of the extender. The finger has a lip 51 at the end thereof slidable over a ramp 52 at the opposite end of outer wall 34. The lip 51 bottoms into a recess 53 adjacent one end of ramp 52 for releasably securing extender 47 to exterior sill member 20.

In addition to being a part of base plate 17, the interior sill member 22 further comprises an upwardly extending wall member 54 forming a support for a wood sill block member 56 secured to base plate 17 by a screw 58. Wall member 54 is parallel to and spaced from inner upright wall 24 of tubular member 23 to form a water trough 60 of a predetermined height and width having one end closed by base plate 17 and the opposite end 62 fully open.

The forementioned weatherseal 39 is preferably any high resiliency weatherseal, such as a foamed plastic, similar to Q-LON (registered trademark of the Schlegel Corporation) Door Seal-650.

An opposite leg 64 of weatherseal 39 is adapted in its unflexed condition, as seen in FIGS. 2 and 3, to extend across open end 62 of water trough 60 and engage a beveled end of wall member 54 to prevent foreign material, such as dirt, leaves, stones, paper, insects, etc. from entering the trough and reducing the effectiveness of the system. By covering the water trough, weatherseal leg 64 also reduces the unsightliness of open end 62 of water trough 60 in threshold 18.

The upright jambs 14 and header 16 are provided with longitudinal kerfs 66 adjacent door stop members 68, seen only in part in FIG. 2, that lie substantially in the same plane as blind slot 36 in threshold 18. Weatherseals 70, similar in form to weatherseal 39 in the threshold, have one leg 72 thereof inserted into kerfs 66. Accordingly, the unflexed legs 64, 74 of the weatherseals 39, 70, respectively, all lie substantially in the same weatherseal plane and form a continuous seal in which the legs 64, 74 are adapted to engage edge margins or surfaces of door 10 when the door is moved into its closed position against the weatherseal legs 64, 74 and stop members 68, as best seen in FIG. 3. This eliminates the requirement for door bottom and corner seals. Any water that is driven into or past seals 39, 70 when door 10 is closed will run downwardly along the peripheral edges or margins of door 10 and along upper surface 76 of sill block member 56, which is preferably inclined downwardly toward water trough 60, into open end 62 of the water trough. The unflexed legs 64, 74 of weatherseals 39, 70 are compressed or flexed in the door-closed position, shown in full lines in FIG. 3, causing threshold leg 64 to uncover the trough from one jamb to the other. In other words, the threshold weatherseal 39 covers open end 62 of trough 60 when the door is open, shown dotted in FIG. 3, and uncovers the open end when the door is closed.

The overall height of threshold 18 is dependent upon the desired height of water trough 60. If a manufacturer desires a door capable of withstanding a water test pressure of around 50 miles per hour, for example, they would require a trough of a depth capable of developing a pressure head of about 1" of water which equates to 5.20 pounds per square foot. If a water test pressure of less than 50 mils per hour is required, the water trough 60 would be built with a depth less than 1" resulting in an overall lower threshold.

The exterior sill member 20 is further provided with a water drainage means comprising a plurality of openings 80, 82 at the lower ends of upright inner and outer walls 24, 26 respectively of tubular member 23, openings 84 in plastic block member 42, openings 86 in the lower end of wall portion 34 and opening 88 in upright walls of extender 47 for draining water from water trough 60 through the exterior sill member 20 and away from threshold 18. To prevent the wind pressure from blowing water inwardly into water trough 60 and over upper surface 76 of sill block member 56 into the room, each of the openings 86 in wall portion 34 is provided with a pivotally mounted cover flap 90 (FIG. 3) to reduce the air flow into or against the water column in water trough 60.

The invention has been described in detail with particular reference to a preferred embodiment thereof, but it will be understood that variations and modifications can be effected within the spirit and scope of the invention.

What is claimed is:

1. An improved self-draining panel threshold combination comprising:

a door frame including a threshold for a panel movable between open and closed positions, the frame surrounding the peripheral edges of the panel in its closed position;

weatherseals in the frame and threshold lying in a common weatherseal plane for flexing and sealingly engaging the panel in its closed position;

a water trough in the threshold having a fully open end extending from one end of the threshold to the other end thereof and lying substantially in the weatherseal plane for catching water that is blown into and past the weatherseals and runs along the panel edges into the open end of the water trough;

the threshold weatherseal further having a portion thereof extending across the open end of the water trough to prevent foreign material from entering the trough when the panel is in its open position and the weatherseal is unflexed; and drainage means in the threshold for draining water entering the water trough out of the threshold.

2. A self-draining panel threshold combination according to claim 1 wherein the threshold comprises a base plate;

an exterior sill member comprising a part of the base plate, and having a first wall extending upwardly from the base plate; and an interior sill member comprisng a part of the base plate, and having a second wall extending upwardly from the base plate and spaced from the first wall to form the water trough.

3. An improved self-draining panel threshold combination according to claim 2 wherein the first wall has a longitudinal slot therein, and the threshold weatherseal comprises one leg mountable within the slot, and the portion of the threshold weatherseal comprises a door engagable leg adapted in its unflexed condition to extend across the open end of the water trough into substantial engagement with the second wall to prevent foreign material from entering the trough.

4. An improved self-draining panel threshold combination according to claim 3 wherein the weatherseal has a substantially V-shaped cross-section.

5. An improved self-draining panel threshold combination according to claim 4 wherein the exterior sill member comprises a tubular member, the first wall is one wall of the tubular member, the part of the base plate thereof comprises another wall of the tubular member, and the drainage means comprises an opening in the one wall and an opening in a third wall of the tubular member opposite the one wall.

6. An improved self-draining panel threshold combination according to claim 5 wherein the third wall has a pivotal flap mounted in front of the drainage opening therein to prevent air from blowing into the opening.

7. An improved self-draining threshold for a panel such as a door comprising:

a base plate;

a first sill member comprising a part of the base plate and having a first wall extending upwardly from the base plate;

a second sill member comprising a part of the base plate adjacent the first sill member and having a second wall extending upwardly from the base plate and spaced from the first wall to form a water trough having an open end for receiving water;

an elongate weatherseal having a mounting leg and a second panel engaging leg wherein the mounting leg is mountable on the first wall and the panel engaging leg in its unflexed condition extends across the open end of the water trough into substantial engagement with the second wall to prevent foreign material from entering the trough; and drainage means in the threshold for draining water entering the water trough out of the threshold.

8. An improved self-draining threshold according to claim 7 wherein the first wall has a longitudinal slot therein, and the weatherseal has a substantially V-shaped cross-section with the mounting leg thereof mountable within the slot.

9. An improved self-draining threshold according to claim 8 wherein the first sill member comprises a tubular member, the first wall is one wall of the tubular member, the part of the base plate thereof comprises another wall of the tubular member, and the drainage means comprises an opening in the one wall and an opening in a third wall of the tubular member opposite the one wall.

10. An improved self-draining threshold according to claim 9 wherein a pivotal flap is mounted in front of the drainage opening in the third wall to prevent air from blowing into the opening.

11. An improved self-draining threshold according to claim 9, and further comprising a U-shaped foot plate mounted on a wall of the tubular member opposite the wall formed by the base plate, the foot plate having a first dependent wall portion adjacent the first wall, and a longitudinal slot in the first wall portion for receiving the mounting leg, the foot plate further having a second dependent wall portion adjacent the third wall of the tubular member, and the drainage means further comprises an opening in the second wall portion.

12. An improved self-draining threshold according to claim 11 wherein a pivotal flap is mounted on the second wall portion in front of the opening in the second wall portion to prevent air from blowing into the opening.

* * * * *